US005887519A

United States Patent [19]

Zelko

[11] Patent Number: 5,887,519

[45] Date of Patent: Mar. 30, 1999

[54] SCREEN PRINTING MACHINES

[76] Inventor: Steve Zelko, 1907 Triumph Street, Vancouver, British Columbia, Canada, V5L 1K6

[21] Appl. No.: 939,407

[22] Filed: Sep. 29, 1997

[51] Int. Cl.[6] ..... B41F 15/04

[52] U.S. Cl. ..... 101/115; 101/123; 101/126; 15/256.5

[58] Field of Search ..... 101/114, 115, 101/123, 125, 126, 127.1, 128.1; 15/256.5

[56] References Cited

U.S. PATENT DOCUMENTS

| | | | |
|---|---|---|---|
| 2,690,118 | 9/1954 | Schwartz et al. | 101/123 |
| 4,084,504 | 4/1978 | Fuchs | 101/115 |
| 4,099,460 | 7/1978 | Bubley et al. | 101/115 |
| 4,909,142 | 3/1990 | Bubley | 101/115 |
| 5,090,311 | 2/1992 | Brasa | 101/115 |
| 5,090,313 | 2/1992 | Chapman | 101/115 |
| 5,154,119 | 10/1992 | Fuqua et al. | 101/123 |
| 5,445,075 | 8/1995 | Panipinto | 101/115 |
| 5,456,172 | 10/1995 | Herrmann | 101/115 |
| 5,613,436 | 3/1997 | Taylor | 101/126 |
| 5,626,074 | 5/1997 | Zelko | 101/115 |
| 5,694,845 | 12/1997 | Newman | 101/126 |
| 5,713,277 | 2/1998 | Szarka | 101/123 |
| 5,722,321 | 3/1998 | Szyszko et al. | 101/123 |

*Primary Examiner*—Eugene Eickholt

[57] ABSTRACT

A screen printing machine has a drive mechanism for moving printing platens along an endless horizontal path through successive printing stations and a printing screen carried by a printing head above the endless path at each printing station. A platen alignment mechanism at each printing station has locating members movable vertically into and out of engagement with freely rotatable rollers on the platen supports. A screen positioning mechanism at each printing station has screen holders engageable with opposite sides of screens, and the screen holders each comprise a screen support mounted for pivotation to and fro between a position beneath one of the screens. A lifting system at each printing station has supports positioned to support opposite ends of one of the printing heads and a support drive mechanism operable to simultaneously raise the supports. A squeegee support bar is provided which has a recess extending longitudinally of the bar at an underside thereof, and an elongate retainer extending longitudinally of the bar and having a projecting portion. The elongate retainer is movable between an operative position, in which the projecting portion releasibly engages and retains a squeegee relative to the squeegee support bar, and a released position, in which the projecting portion releases the squeegee from the bar.

25 Claims, 18 Drawing Sheets

SCREEN PRINTING MACHINES

BACKGROUND OF THE INVENTION

1. Field of the Invention

The present invention relates to screen printing machines and, more particularly, to screen printing machines in which printing platens are moved around an endless path through successive printing stations.

2. Description of the Related Art

Screen printing machines of this type are known, for example, for printing T-shirts, and such machines usually comprise a plurality of printing stations, each provided with a printing screen, an inking and squeegee system for applying ink to the screen and a platen alignment system for locating the platens in position as the platens arrive, in succession, at each printing station.

In such machines, the platens are driven by means of an endless chain drive mechanism around their endless path on a machine bed. The alignment of each platen at each printing station has been effected by means of an alignment mechanism applying force to the platens in a direction extending transversely of the path of travel of the platens. This has the disadvantage that the force exerted by this alignment mechanism tends to force components of the machine frame at opposite sides of the path of travel apart from one another, thus adversely affecting the accurate positioning of the platens at the printing station during printing operations.

More particularly, the frames of screen printing machines are normally constructed of frame components which are bolted together and which, consequently, tend to flex out of shape when subjected to forces tending to urge the frame components apart from one another. However, for accurate printing at successive printing stations, it is necessary to ensure that each platen is accurately located in position during each printing operation.

In prior art printing machines, as each platen arrives at a printing station, it is pushed so as to slide horizontally, in a direction transverse to the path of travel of the platen, to urge a drive chain, provided for displacing the platen around the path, into abutment with a rail in order to register the platen for printing.

Since each of the platens is simultaneously forced so as to slide against friction into abutment this way, and since the forces acting on the platens are exerted transversely of the path of travel of the platens, the machine frame is thus subjected to these forces, at various positions, and consequently the components of the machine frame are deflected, thus adversely affecting the accuracy of the registration of the platens.

BRIEF SUMMARY OF THE INVENTION

According to the present invention, there is provided a screen printing machine comprising a drive mechanism operable to displace printing platens along an endless horizontal path extending through successive printing stations, and a platen alignment mechanism is provided at each printing station which comprises a locating member mounted for vertical to-and-fro movement between a first position in which the locating member engages a platen support carrying a respective one of the platens, and a second position, in which the locating member is spaced from the platen support.

In a preferred embodiment of the invention, the locating member comprises a vertically displaceable bar provided, at opposite sides, with V-shaped recesses, and the platen support is provided with locating rollers which are spaced apart to receive the bar therebetween and which have V-shaped formations shaped for interengagement with the V-shaped recesses of the bar.

With this platen alignment mechanism, each platen can, in succession, be accurately located in position at the respective printing station, by vertical displacement of the alignment bar into interengagement with the locating rollers of its platen support. Consequently, no forces are exerted on the platens or on other parts of the machine which act in a direction transverse to the endless horizontal path.

The preferred embodiment of the present invention also includes a screen loading and unloading mechanism at each printing station, the screen loading and unloading mechanism including screen holders which are engageable with opposite sides of a printing screen. Each of the screen holders comprises a screen support which is mounted for pivotation to and fro between a first position, beneath the screen, and a second position, removed from the screen.

An adjustment mechanism is operable to adjust the positions of the screen holders and, thereby, to correspondingly adjust the position of the screen. For this purpose, the screen holder and the screen have mutually engageable locating formations, and the adjustment mechanism is operable to adjust the position of the locating formations of the screen holders and, thereby, to correspondingly adjust the position of the screen on interengagement of the locating formations of the screen and the screen holder.

This adjustment mechanism comprises independently actuatable members for adjustably displacing the locating formation of one of the screen holders in mutually orthogonal horizontal directions.

The screen holders are also provided with screen clamping devices, which each comprise a clamp movable into a clamping position for engaging the screen between the clamp and the screen support, and an actuator which is operable to displace the clamping devices to and from their clamping positions.

The screen printing machine according to the present invention includes printing heads spanning the path of travel of the platens at each printing station and carrying the printing screens and a lifting system for simultaneously lifting opposite ends of the printing heads. The lifting system comprises a prime mover and a belt and pulley system connected to be driven by the prime mover, the belt and pulley system comprising pairs of horizontally spaced, vertically extending belts at opposite sides of the endless path, connections being provided between each of the belts and the printing head supports on which the printing heads are mounted.

BRIEF DESCRIPTION OF THE DRAWINGS

The present invention will be more readily understood from the following description thereof given, by way of example, with reference to the accompanying drawings, in which.

DESCRIPTION OF THE PREFERRED EMBODIMENT

Figure 1:
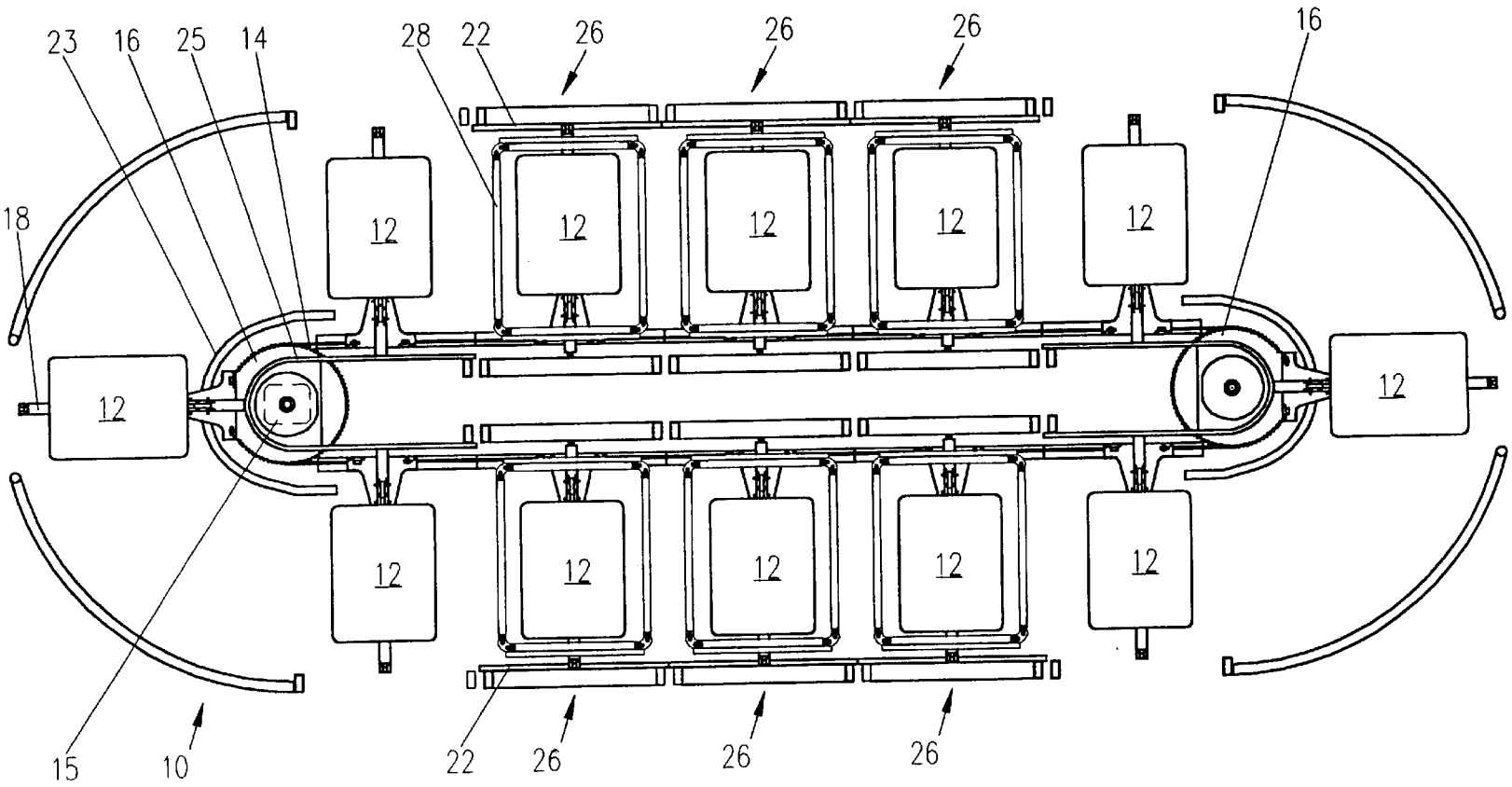
FIG. 1 shows a plan view of a screen printing machine according to the present invention.

The printing machine shown in FIG. 1, which is indicated generally by reference numeral 10, has twelve platens 12 which, in operation of the screen printing machine 10, are driven around a horizontal endless path means of a drive chain 14 and a pair of sprockets 16 engaging the drive chain 14, one of the sprockets 16 being driven by a servomotor 15. It is, however, pointed out that the present invention may be embodied with more than, or fewer than, twelve platens.

Figure 3:
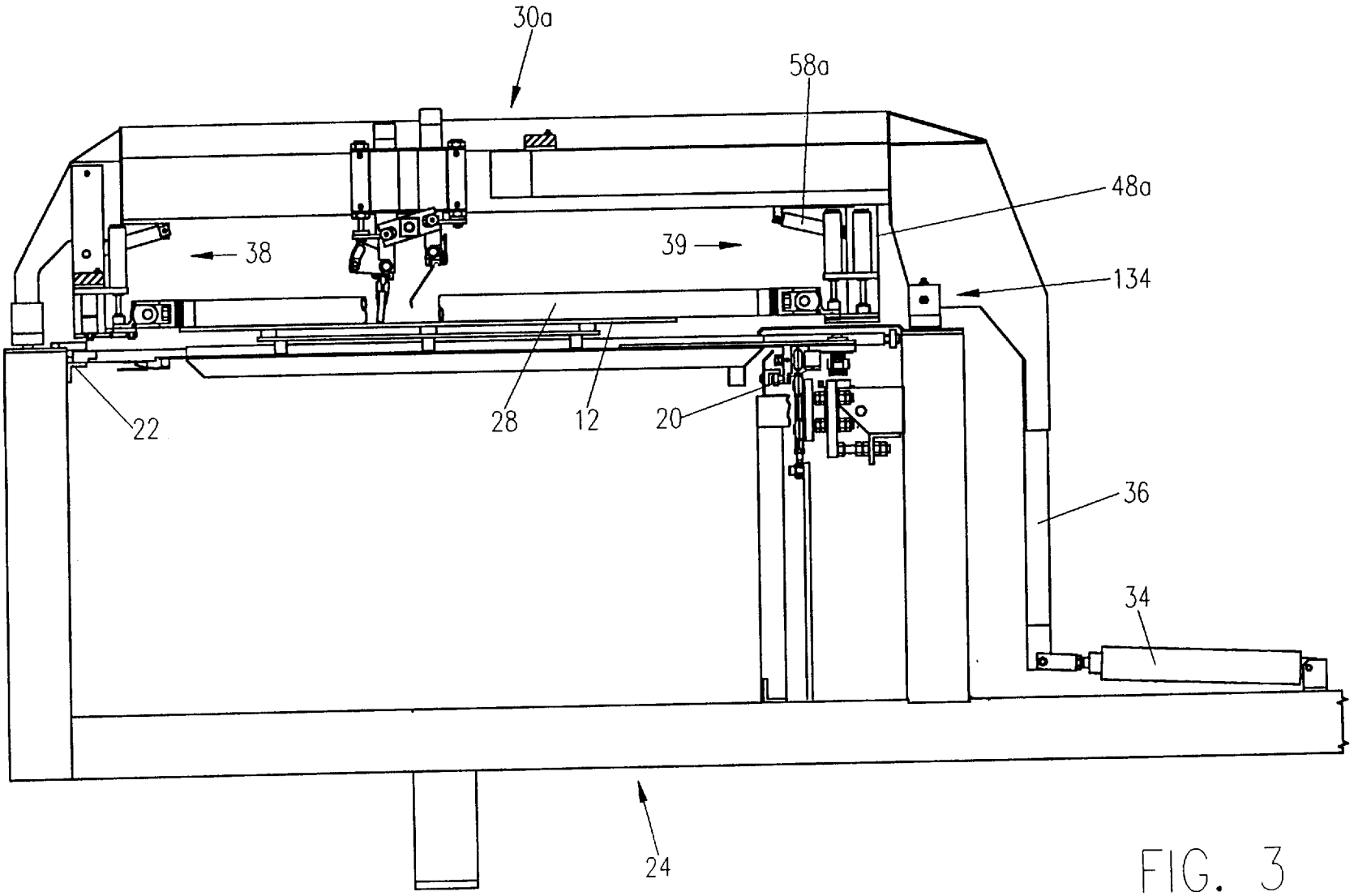
FIG. 3 shows on an enlarged scale, a view of parts of the apparatus shown in FIG. 2.

The platens 12 are carried on platen supports in the form of platen support arms 18 which are supported, at their inner and outer ends, on inner and outer endless tracks 20 and 22 (see FIG. 3), provided on a machine frame indicated generally by reference numeral 24 in FIG. 3. At opposite ends of the machine, the track 22 is interrupted, and the platen support arms 18 are supported by a curved track 23 underlying the platen support arms 18 and a curved retainer rail 25 overlying the platen support arms 18, the track 23 and the rail 25 being provided at the inner side of the path of travel of the platens 12.

The endless path of movement of the platens 12 extends through six printing stations, indicated generally by reference numerals 26, at which screen frames 28 are provided, as described in greater detail below, for use in screen printing.

In operation of the screen printing machine 10, the platens 12 are moved around their endless path with an intermittent motion, so that each platen 12 is temporarily located in succession at each of the printing stations 26 to enable a printing operation to be effected at each printing station.

Figure 2:
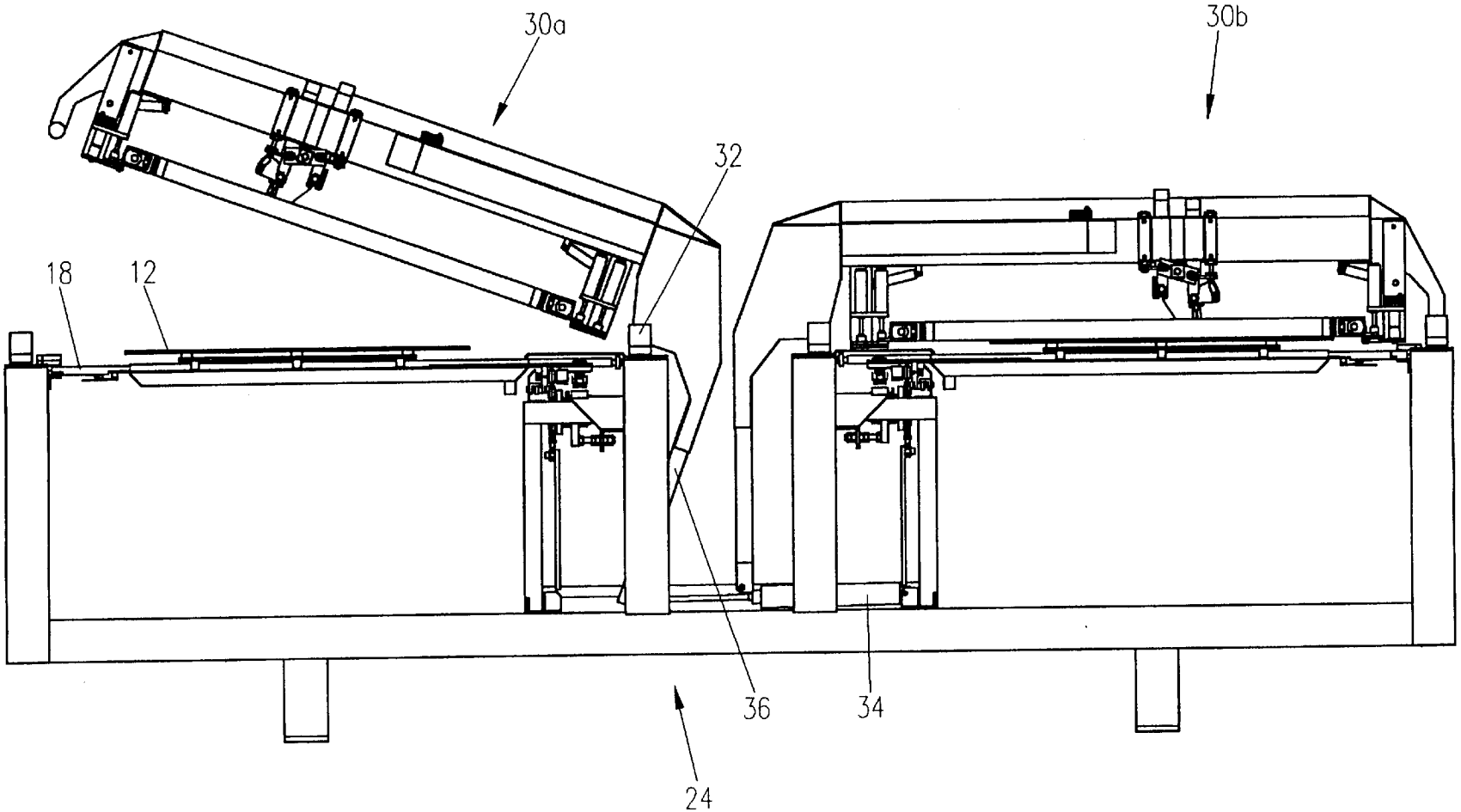
FIG. 2 shows a view taken in transverse cross-section through the printing machine along the line 2—2 of FIG. 1.

Turning now to FIGS. 2 and 3 of the accompanying drawings, each printing station 26 is equipped with pivotable printing heads, two of which are indicated, respectively, by reference numerals 30*a* and 30*b* in FIG. 2, spanning the path of travel of the platens 12. These printing heads are similar in construction to one another and, therefore, only one of them will be described in further detail in the present specification.

As shown in FIG. 2, the printing head 30*a* has been pivoted into a raised position, whereas the printing head 30*b* is in a lowered position.

More particularly, the printing head 30*a* is vertically pivotable about a horizontal pivot 32 by the action of a pneumatic piston and cylinder device 34, which is connected between the machine bed 24 and the lower end of an arm 36 depending from one end of the printing head 30*a*.

One of the screen frames 28 is illustrated in greater detail in FIG. 4, from which it can be seen that this screen frame 28 comprises four rollers 40 connected in a rectangular array by corner connectors 42, the frame also including, at opposite ends thereof, a pair of reinforcement rails 44, each of which is formed with a frame alignment opening 46 and a further hole 47 employed, as described below, for loading and unloading the printing screen 28.

Apart from the holes 47, the components and features of the screen frame 28 are described in greater detail in co-pending patent application Ser. No. 08/728,898, filed Oct. 10, 1996, the disclosure of which is incorporated herein by reference.

The screen holder 38 will now be described with reference to FIGS. 4 through 8. As shown in greater detail in FIG. 3, the printing head 30*a* has two screen holders indicated generally by reference numerals 38 and 39, which are described in greater detail below.

Figure 5:
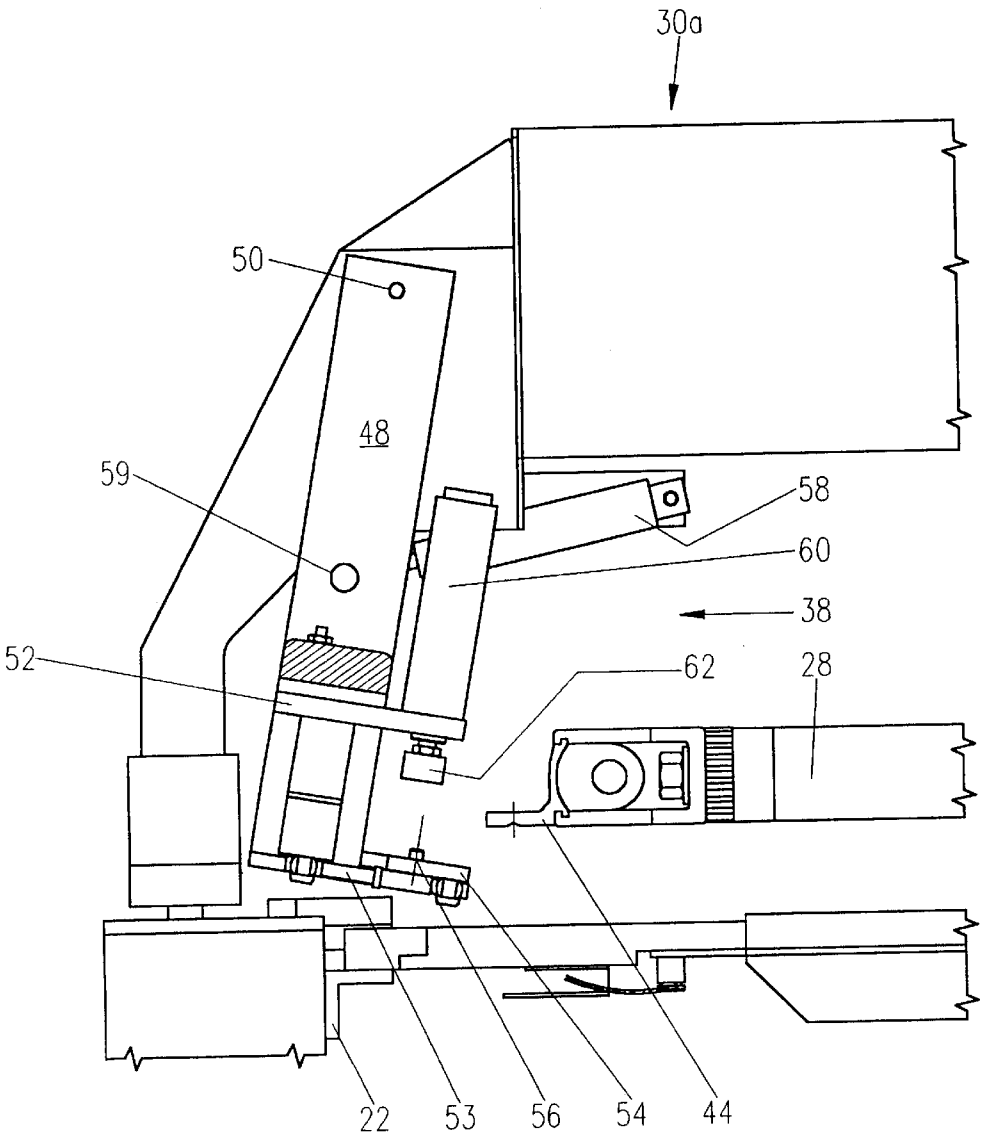
FIG. 5 shows a broken-away view, on an enlarged scale, of parts of the apparatus of FIG. 3.
Figure 6:
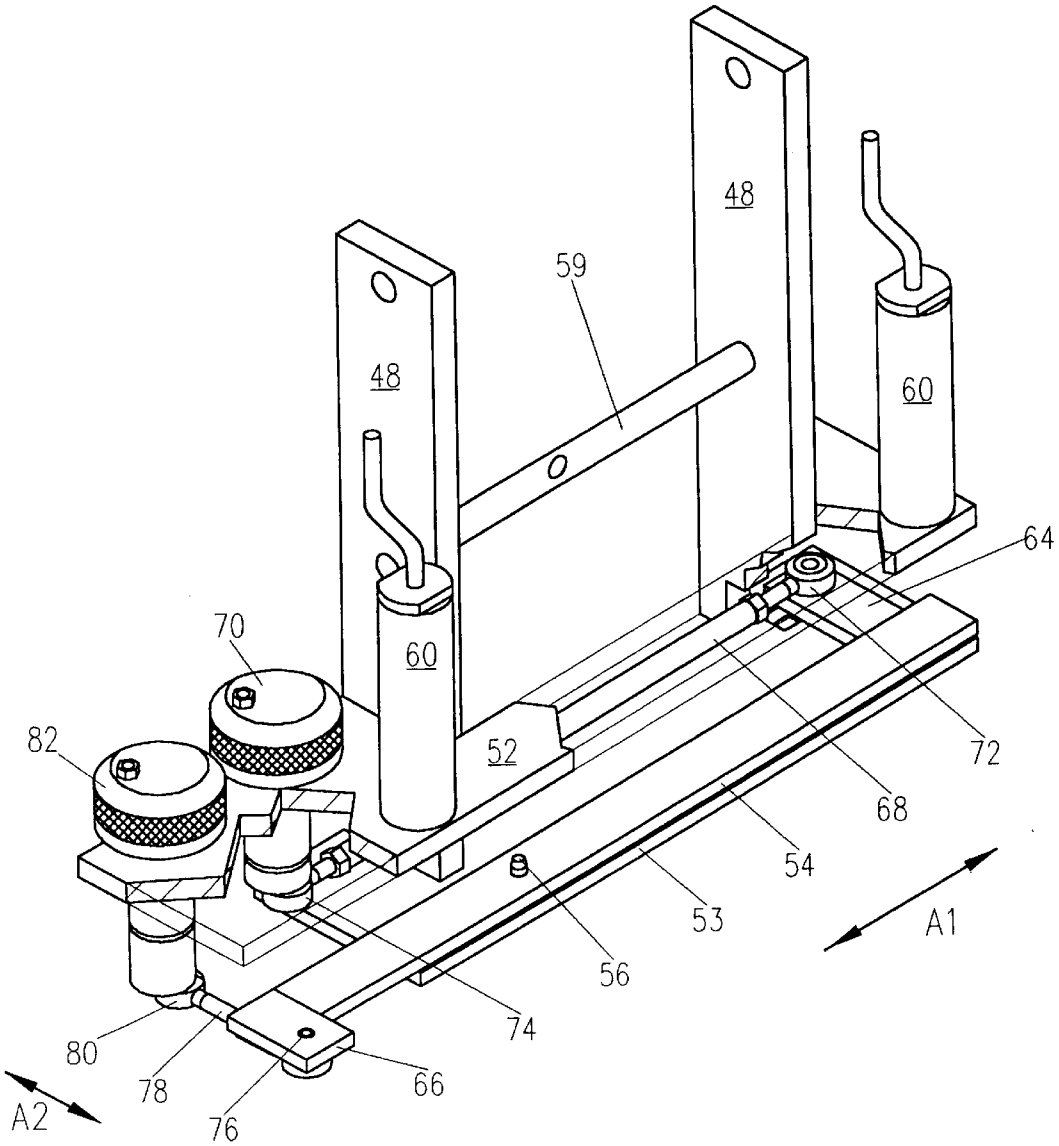
FIG. 6 shows a partially broken-away view, in perspective of one of the screen adjustment mechanisms FIG. 4.

As shown in FIGS. 5 and 6, the screen holder 38 comprises a pair of lever arms 48 which are pivotable, in a vertical plane, about a horizontal pivot 50. The arms 48, as shown in FIG. 6, carry a mounting plate 52 and a lower plate 53. A frame support bar 54 is adjustably connected to the mounting plate 52 and the lower plate 53, and is provided with a screen locating formation in the form of a bevelled locating pin 56 extending upwardly from the support bar 54. This locating pin 56 is engageable in a corresponding one of the alignment holes 46 of the screen frame 28, which hole serves as a locating formation for locating the latter in position.

By means of a pneumatic piston and cylinder device 58 (FIG. 5), connected between the printing head 30*a* and a rod 59 connecting the bars 48, the latter can be pivoted about pivot 50 to move the support bar 54 from the position in which it is shown in FIG. 5 into a position (not shown) in which it underlies the reinforcement rail 44 of the screen frame 28 and in which the alignment pin 56 is located vertically below the alignment opening 46.

In this operative position of the support bar 54, a pneumatic piston and cylinder device 60 can be activated to move a clamp 62 downwardly into pressing engagement with the reinforcement rail 44 so as to thereby clamp the reinforcement rail 44 between the clamp 62 and the support bar 54. The piston and cylinder device 60 and the clamp 62 thus form parts of a clamping device for clamping engagement with the printing screen 28. In this way, the screen frame 28 is accurately located in position at its printing station.

This position of the screen frame 28 can be manually adjusted by adjustment of the support bar 54 and its alignment pin 56.

Figure 7:
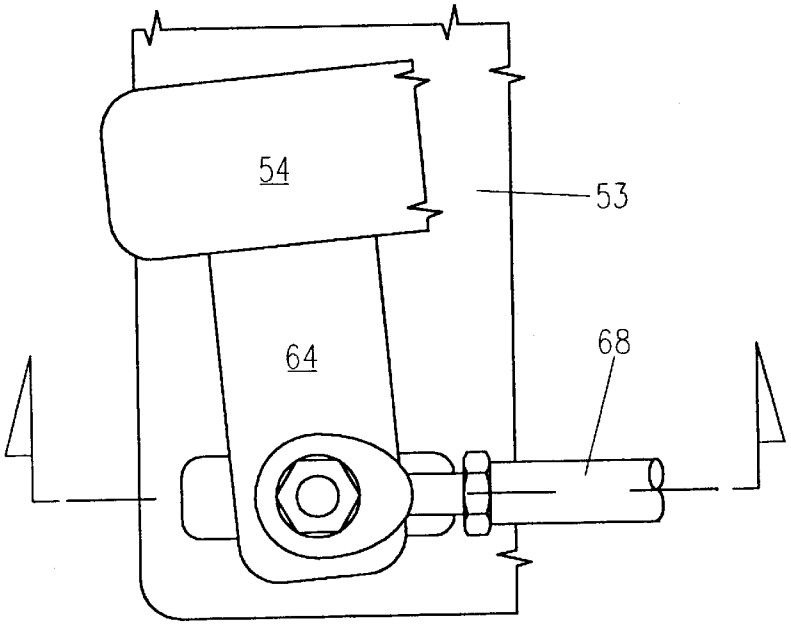
FIGS. 7 and 8 show, respectively, a plan view and a view in vertical cross-section through parts of the screen adjustment mechanism of FIG. 1.
Figure 8:
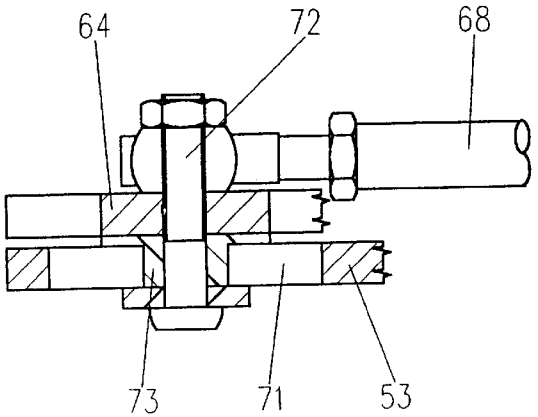

The support bar 54 is connected, at opposite ends, to arms 64 and 66 (FIGS. 6, 7 and 8). The arm 64 is connected by means of a connecting rod 68 to an adjustment knob 70. More particularly, the connecting rod 68 is pivotably connected at one end, by means of a pivot connection 72, to the arm 64 and, in addition, is eccentrically pivotably connected, at its opposite end, by means of an eccentric pivot 74 to the adjustment knob 70. By manual rotation of the adjustment knob 70, therefore, the support bar 54 can be horizontally adjustably displaced, to and fro, in the direction of double-headed arrow A1. To allow this movement, the lower plate 53 is formed with a slot 71 and the pivot 62 extends through a slide member 73 which is slidable to and fro along the slot 71.

Figure 9:
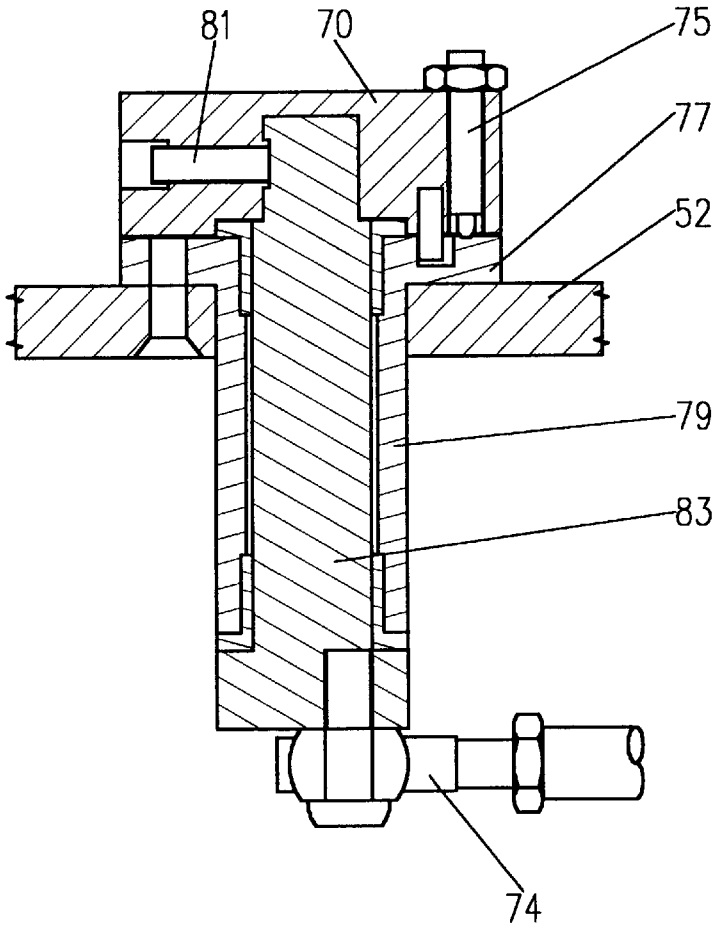
FIG. 9 shows a view in vertical cross-section through parts of a screen adjustment mechanism of FIG. 3.

As shown in FIG. 9, the knob 70 is provided with a spring-biased detent 75 which engages in detent recesses (not shown) in the upper surface of a circular flange 77 of a sleeve 79 secured to the plate 52, and the knob 70 is secured by a screw 81 to a vertical shaft 83 eccentrically connected to the arm 68 by the eccentric pivot 74.

The arm 66 is connected, by means of a pivot connection 76, a connecting rod 78 and an eccentric pivot connection 80, to a manually adjustable knob 82, by means of which the arm 66 and, therewith, the support bar 54 can be adjusted to and fro as indicated by double-headed arrow A2 in a direction orthogonal to that of arrow A1.

Figure 4:
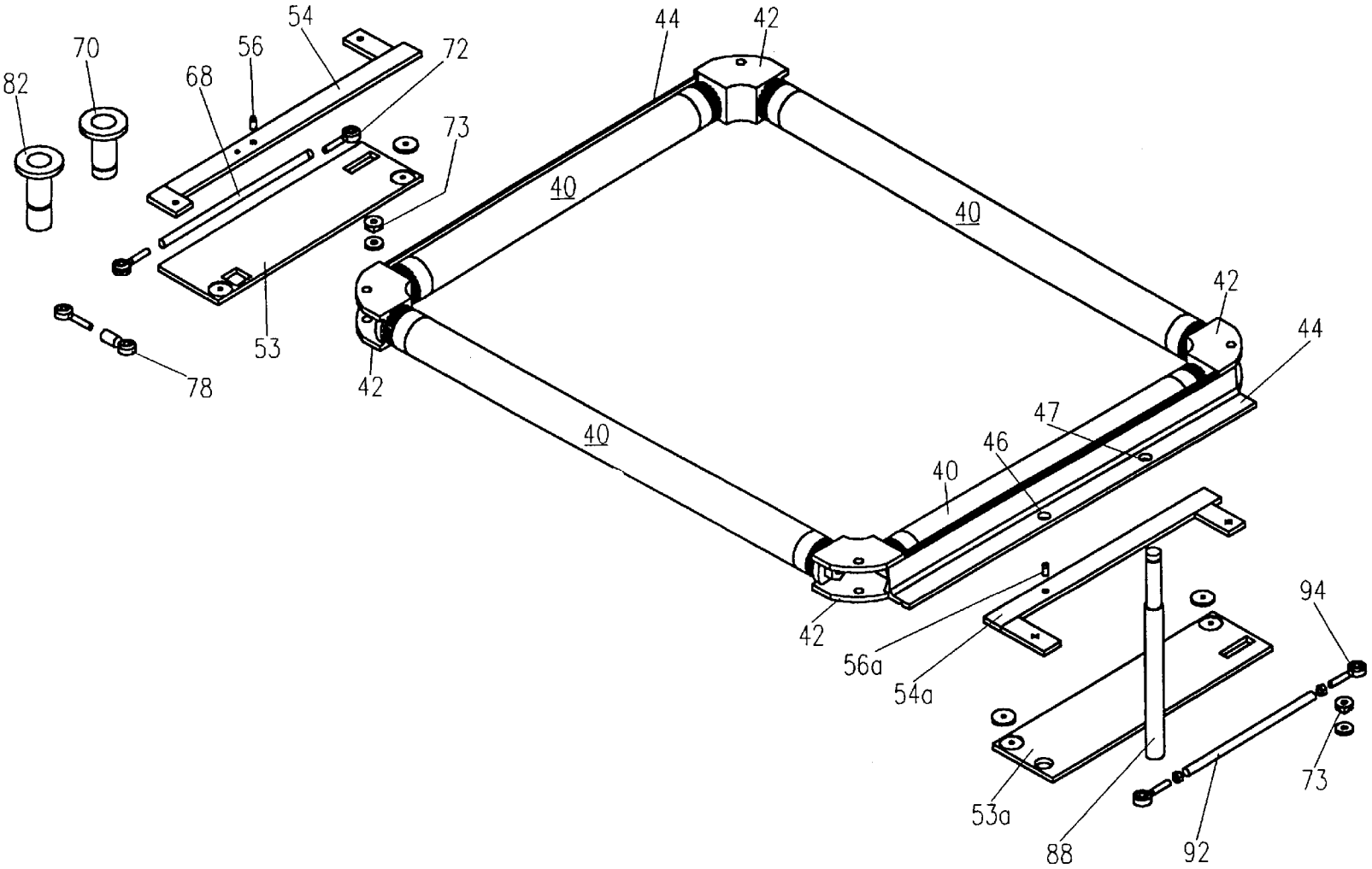
FIG. 4 shows a partly-exploded view of a printing screen frame and components of adjustment mechanisms for adjustment of the position of the printing screen.
Figure 10:
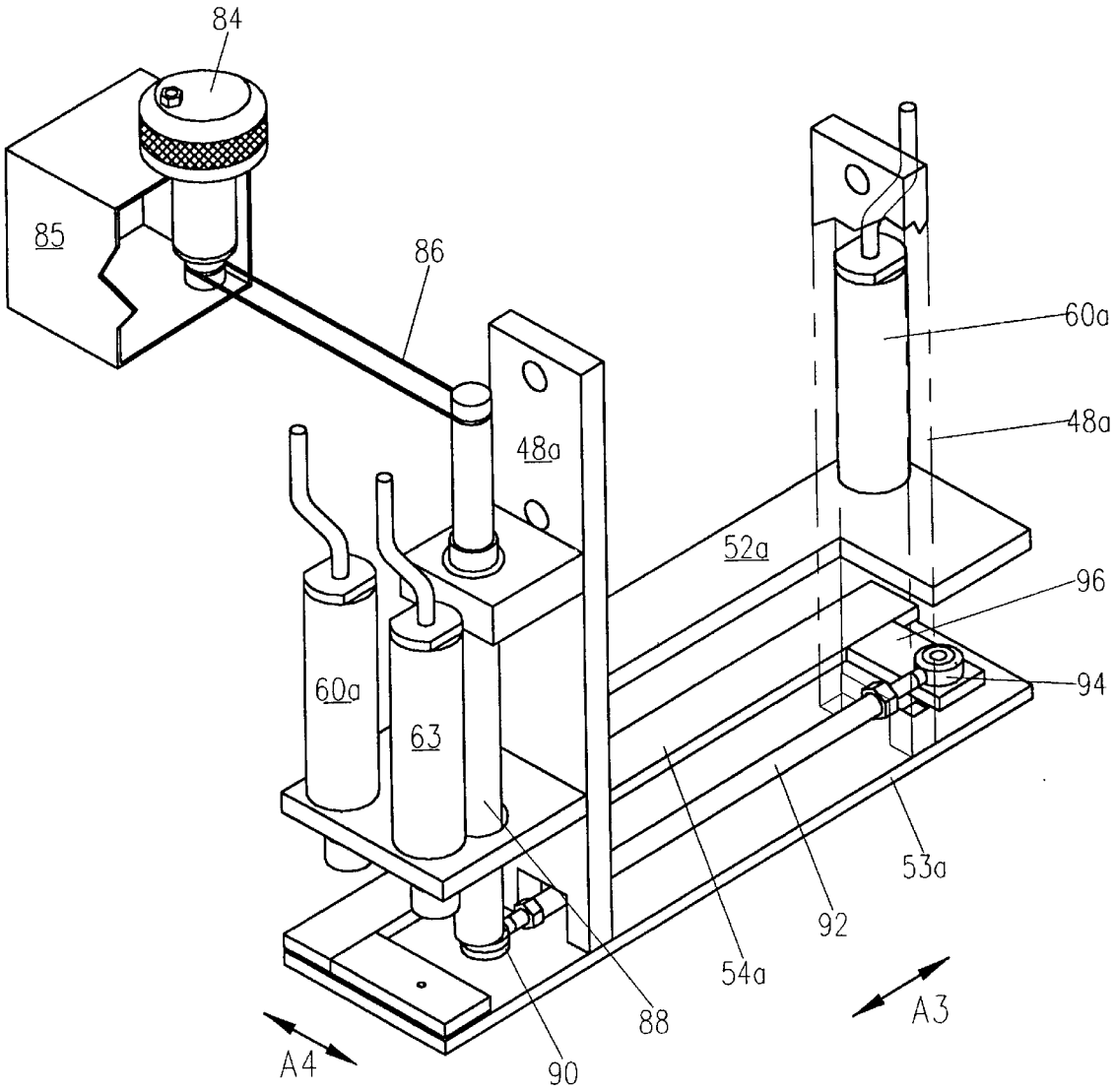
FIG. 10 shows a view, in perspective, of components of another screen adjustment mechanism of FIG. 3.

The opposite end of the screen frame 28 is supported on the screen support 39, components of which are shown in FIGS. 4 and 10.

The screen holder 39 has a screen support bar 54*a*, which is provided with an upstanding alignment pin 56*a* (FIG. 4), corresponding to the pin 56 of FIG. 4, for engagement in the alignment hole 46 at the innermost end of the screen frame 28. The support bar 54*a* is carried on a mounting plate 53*a*, which is suspended by the lower ends of pivotable arms 48*a*, for pivotation to and fro, between an operative position beneath the screen frame reinforcement strip 44 and an inoperative position spaced from the screen frame, by means of pneumatic piston and cylinder device 58*a* (FIG. 3) connected between the printing head 30*a* and the arms 48*a*.

The support bar 54*a* and, therewith, the alignment pin 56*a* are adjustable to and fro, as indicated by double-headed arrow A3, by means of a manual adjustment knob 84, which is rotatably mounted on a component 85 of the machine frame 24. An endless belt 86 connects the knob 84 to a vertical rod 88 which, at its lower end, is connected by an eccentric pivot 90 for longitudinally displacing a connecting rod 92, which in turn is connected by a pivot connection 94 to an arm 96 extending from the support bar 54*a*. In this way, the screen support bar 34*a* and its alignment pin 52*a* can be adjusted to and fro as indicated by double-headed arrow A3. Movements in the direction of arrow A4 occur in response to adjustment of the printing screen by the knob 82 of FIG. 6.

The pivotable arms 48*a* also carry a mounting plate 52*a*, on which are mounted a pair of clamping devices which have pneumatic piston and cylinder devices 60*a* and which are similar to the clamping devices of FIG. 5, comprising the piston and cylinder devices 60 and the clamp 62, and an additional clamping device comprising a pneumatic piston and cylinder device 63.

Figure 11:
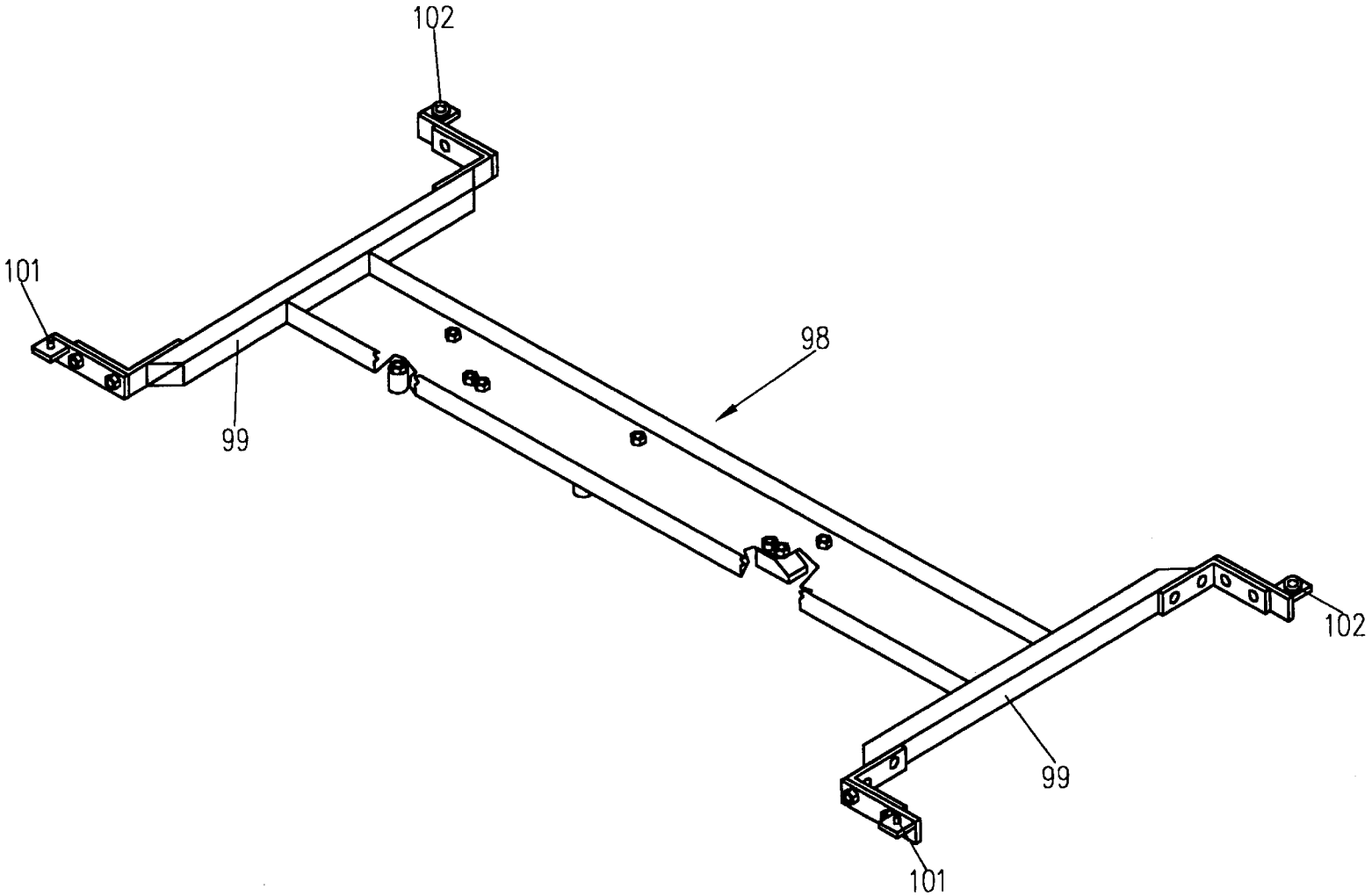
FIG. 11 shows a view in perspective of a jig for use in loading and unloading printing screens in the machine of FIG. 1.
Figure 12:
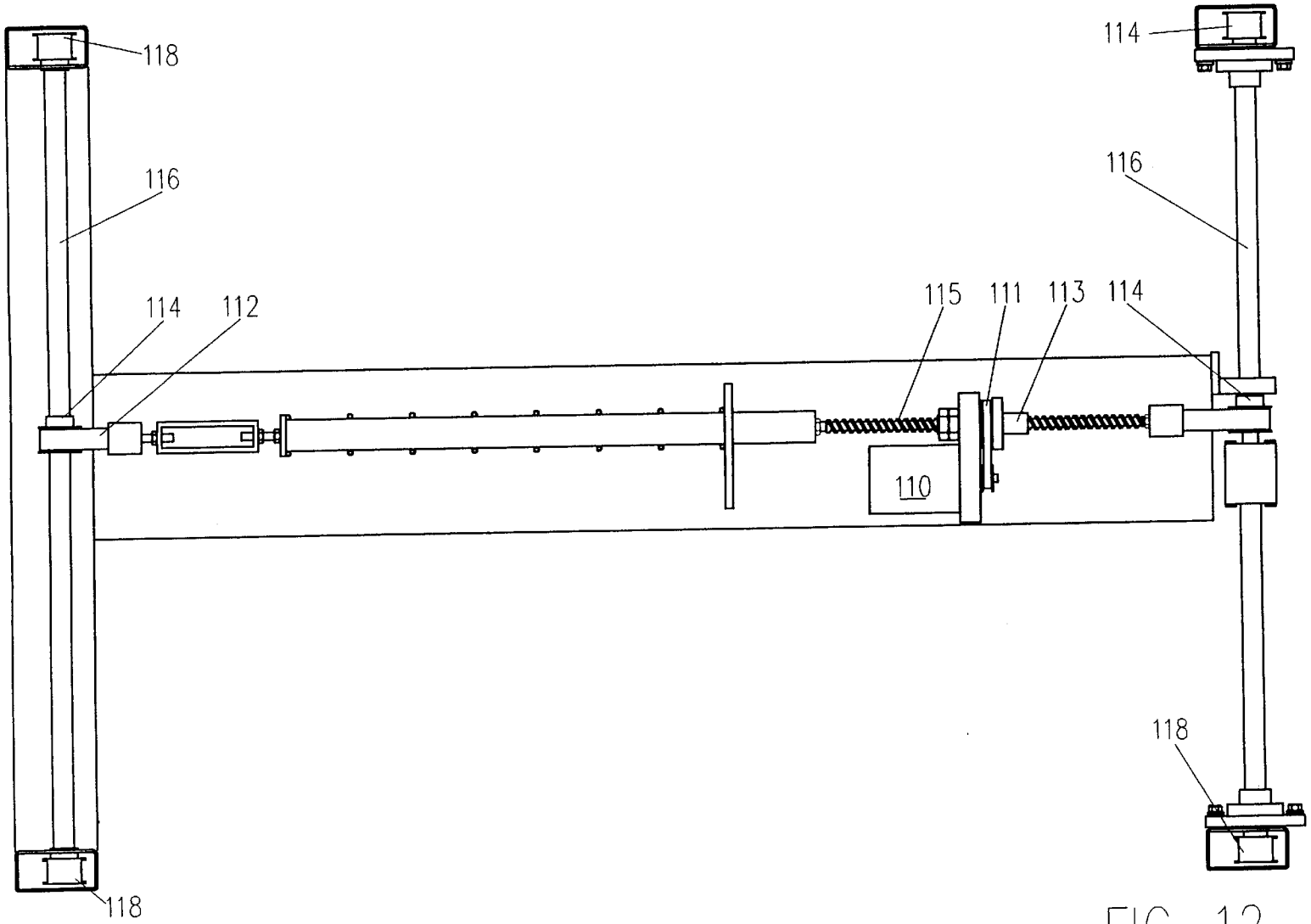
FIG. 12 shows an underneath plan view of parts of a belt and pulley lifting system of the machine of FIG. 1.
Figure 13:
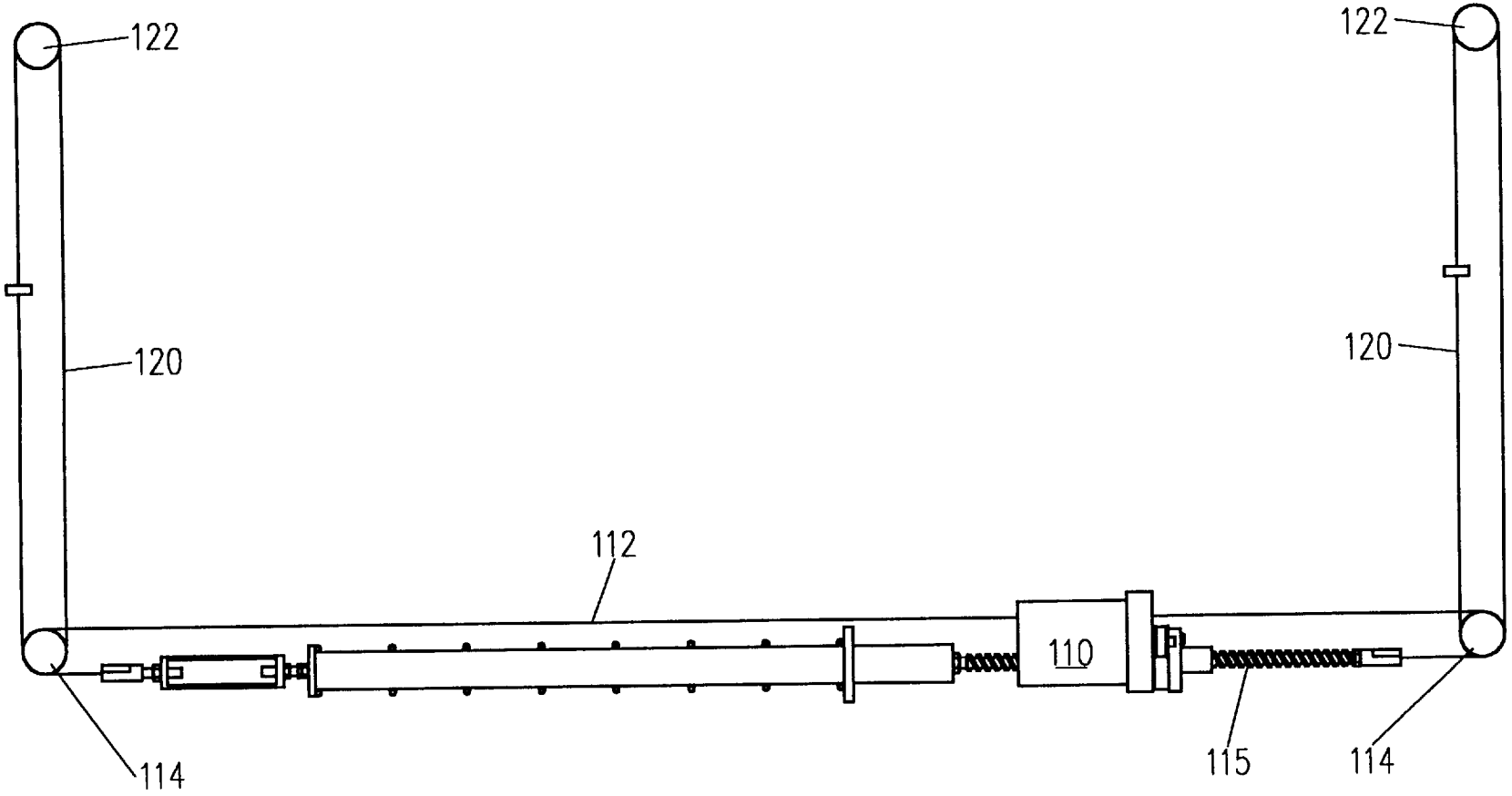
FIG. 13 shows a view inside elevation of the belt and pulley mechanism of FIG. 12.

FIG. 11 shows a temporary screen support, which is indicated generally by reference numeral 98 and which is for use in automatically loading and unloading the printing screens 28 to and from the printing machine 10.

The screen support 98 comprises a jig having, at opposite ends, transverse arms 99, which are connected by an elongate intermediate portion 100. Each arm 99 has, at one end, an upstanding locating pin 101 and, at its opposite end, an upwardly facing abutment 102.

The screen support 98 can be fastened to any one of the platen support arms 18, in place of its platen 12, and then serves to carry one of the printing screens 28 to and from its printing station 26, at which the screen is automatically loaded onto or unloaded from the respective printing head 30 or 30*a*, as described below. For this purpose, the locating pins 101 of the temporary screen support 98 are engaged in the holes 47 of the reinforcement rails 44 (FIG. 4) of the printing screen, while the abutments 102 engage and support the undersides of the reinforcement rails 44. The arms 99 of the temporary screen support 98 can then carry the printing screen to its printing station 26 in a manner such as to allow the printing screen to be engaged by the screen holders 38 and 39 and then upwardly removed from the temporary support by raising of the respective printing head as described below.

Likewise, by reversing these operations, this printing screen can be deposited from the printing head onto the temporary screen support by lowering the printing head, and then released by the screen holders 38 and 39, to allow the printing screen to be carried from its printing station to one end of the printing machine 10 for unloading the screen.

A printing head lifting system, illustrated in FIGS. 12 through 16, is provided for raising and lowering the printing head 30*a* and comprises a prime mover, in the form of a stepping motor 110, which, through a pulley and belt connection 111, rotates a nut 113 in threaded engagement with a worm shaft 115 and thereby longitudinally displaces the latter. The worm shaft 115 is connected by a horizontal belt 112 to a pair of pulleys 114. The pulleys 114 are fixed to parallel horizontal shafts 116, which are rotatably secured to the machine frame 24 and which, at their ends, carry pulleys 118. Two pairs of vertically extending endless belts 120, located at the inner and outer sides, respectively, of the path of travel of the platens 12, extend upwardly from the pulleys 118 to upper pulleys 122.

The two endless belts 120, of each pair, are interconnected by a cross-piece 124, 124*a* (FIGS. 14 and 16), which are movable to and fro vertically and simultaneously, by means of the endless belts 120, the vertical movement of the cross-pieces 124 being guided by means of guide rods 126, 126*a* secured to the machine frame 24.

Figure 14:
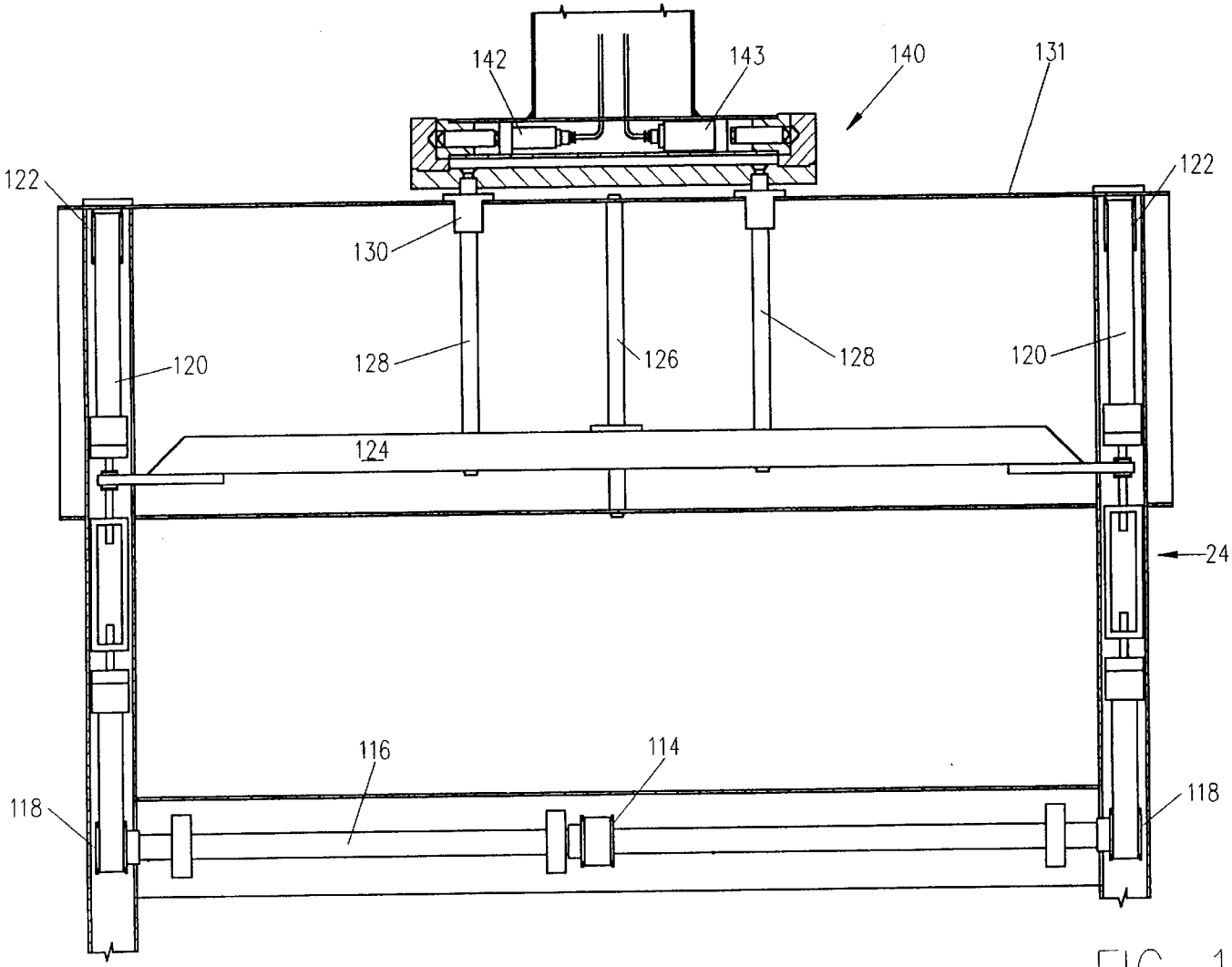
FIG. 14 shows a view, taken in section transversely of the machine of FIG. 1 and illustrating parts of the lifting system.
Figure 15:
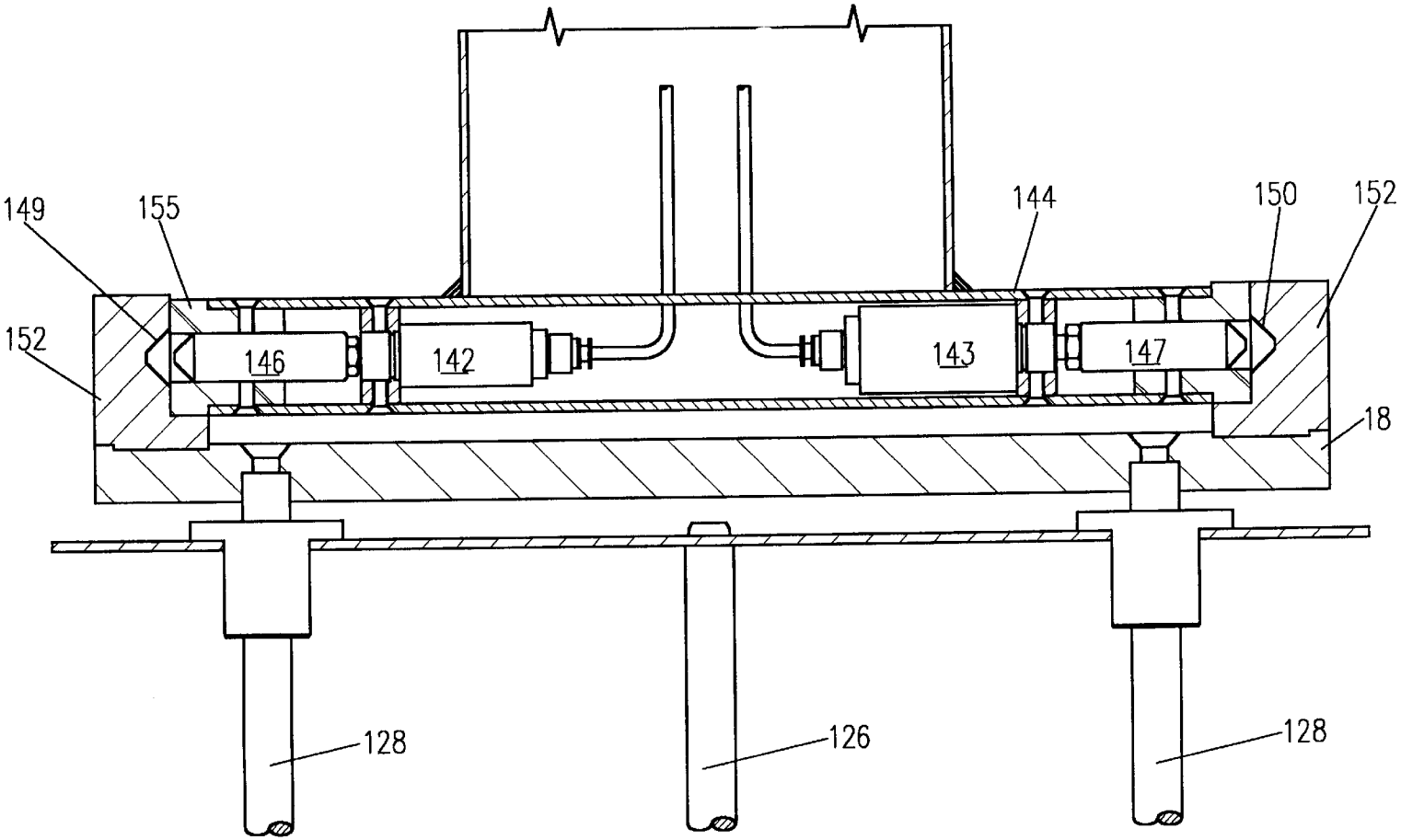
FIG. 15 shows a view, partially in vertical cross-section, of a locking mechanism.
Figure 16:
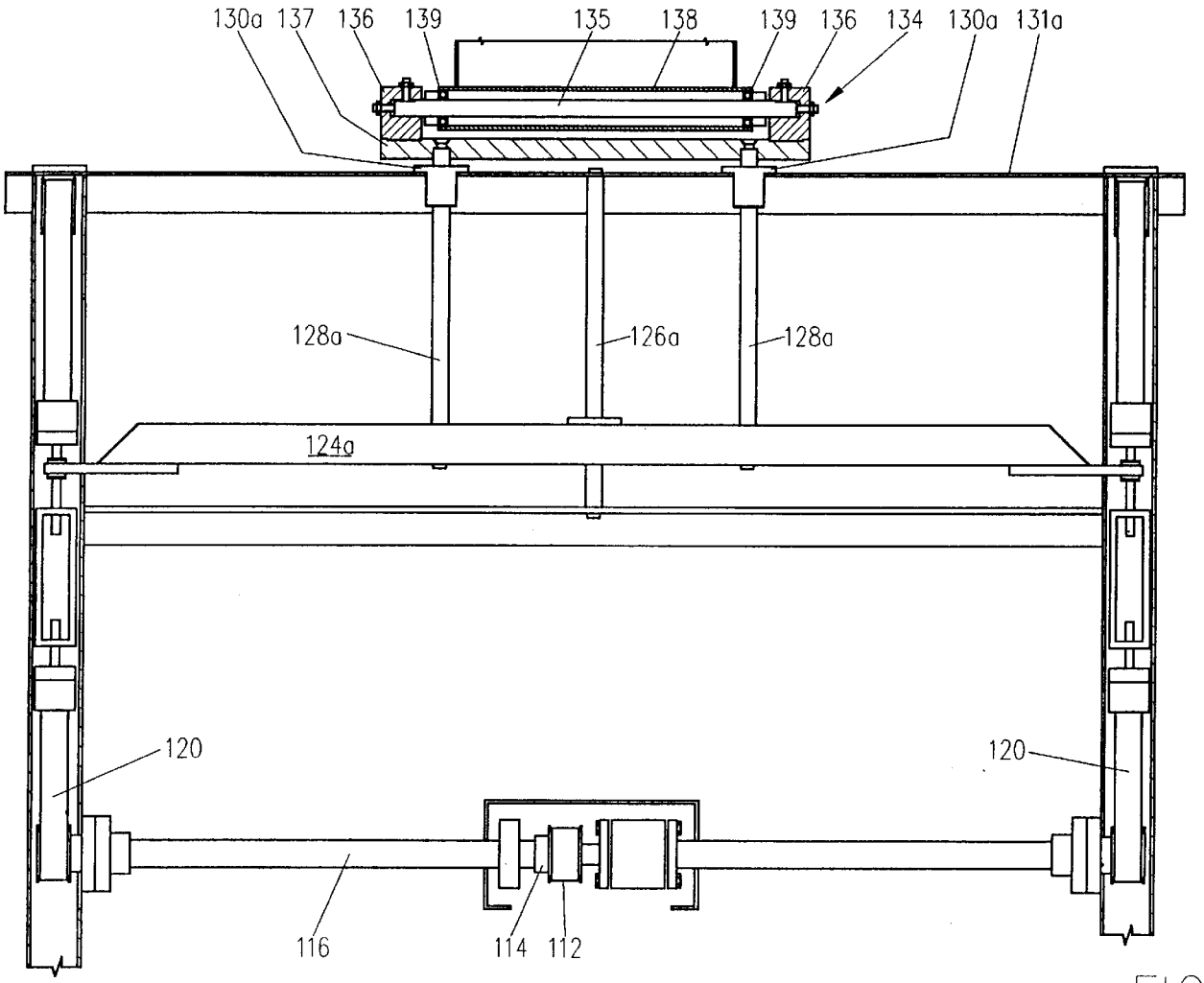
FIG. 16 shows a view taken in cross-section transversely of the machine of FIG. 1 in a direction opposite to that of FIG. 14.

The cross-pieces 124, 124*a* each support a pair of horizontally spaced, vertical rods 128, 128*a*, which are slidably guided by means of guide sleeves 130, 130*a* supported on housings 131 and 131*a* on the machine frame 24, two of the rods 128 being connected, at their upper ends and at the outer side of the path of travel of the platens 12, to a locking device indicated generally by reference numeral 140 in FIG. 14 and illustrated in greater detail in FIG. 15, which serves to lock the printing head 30*a* to the cross-piece 124. The locking device 140 has a pair of oppositely operating piston and cylinder devices 142 and 143 (FIG. 15), which are housed in a cylindrical housing 144 and which serve to displace to and fro a pair of oppositely directed locking pins 146 and 147. The pins 146 and 147, on extension of their pneumatic piston and cylinder devices 142 and 143, engage in recesses 149 and 150 in blocks 152.

As can be seen from FIG. 15, the pneumatic piston and cylinder device 143 is of larger cross-section than the pneumatic piston and cylinder device 142. Consequently, the piston and cylinder device 143 will exert a greater force than the piston and cylinder device 142 and, thus, will ensure that the block 152 at the left-hand end of the housing 144, as viewed in FIG. 15, will act as an abutment which will always be forced into abutment with a counter-abutment bushing 155 on the housing 144 on extension of the piston and cylinder devices 142 and 143. Since the housing 144 is fixedly connected to the printing head, this ensures that the locking device 140 serves to accurately position and retain the printing head relative to the machine frame 24.

At the inner side of the path of travel of the platens 28*a*, the rods 128*a* support a pivot connection, indicated generally by reference numeral 134, which includes a pivot shaft 135 secured at its ends to blocks 136 carried on a mounting bar 137, supported on the rods 128*a*, and a cylindrical sleeve 138 which is co-axially and rotatably mounted on the pivot shaft by bearings 139 and forms part of the printing head 30*a*.

On release of this locking device 140, the printing head can be pivoted about the pivot shaft 135 by operation of the piston and cylinder device 34 (FIG. 3) so as to raise the printing screen to provide access to the underside of the screen for cleaning, and other maintenance and inspection purposes.

With the printing head lowered and locked by the locking device 140, the printing head lifting system of FIGS. 12 through 16 is employed for raising the printing head as each platen 28 arrives at the respective printing station 26 and lowering the printing head to lower the respective printing screen 28 into position for printing.

Also, the printing head lifting system is employed to raise and lower the printing head during loading and unloading of the printing screen to and from the printing head as described above.

Figure 17:
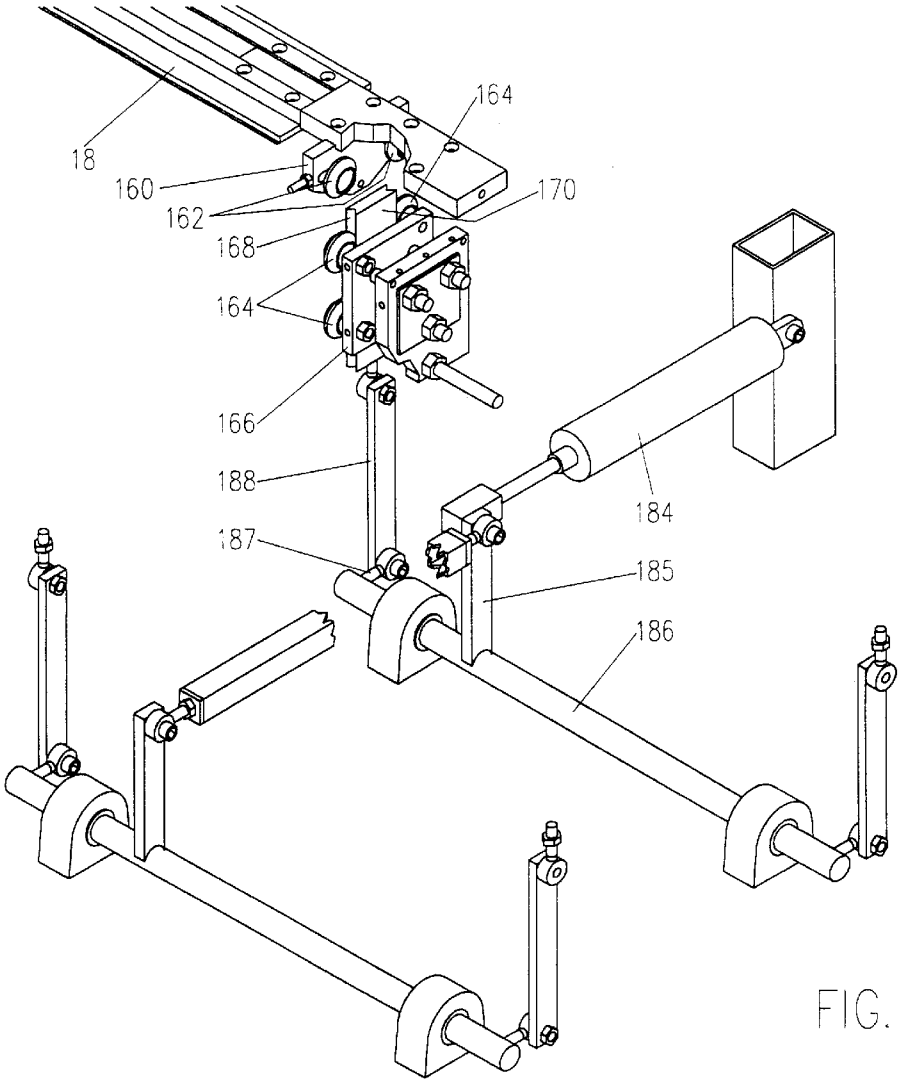
FIG. 17 shows a broken-away view, in perspective, of components of a platen alignment mechanism forming part of the printing machine of FIG. 1.
Figure 18:
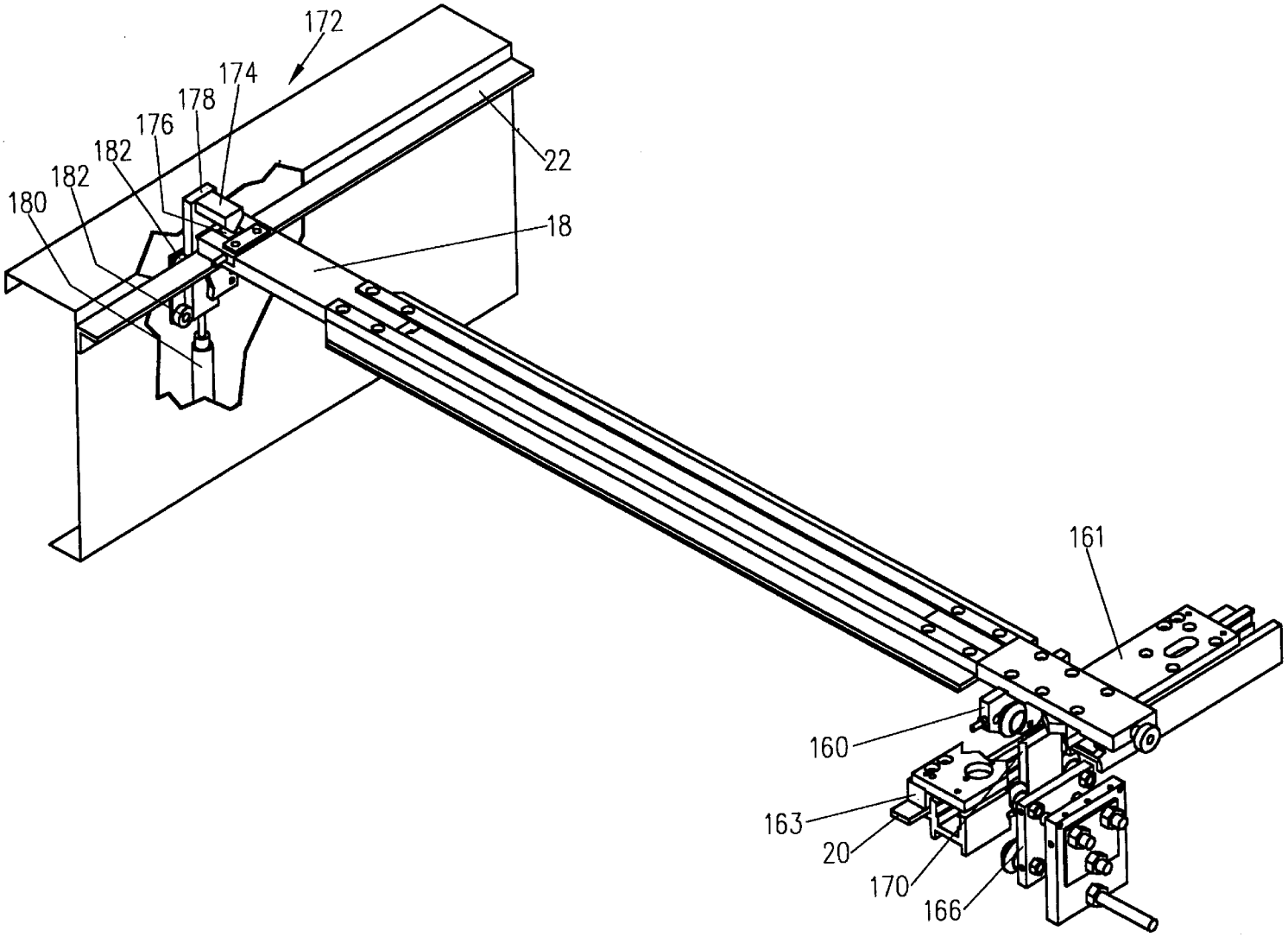
FIG. 18 shows a broken-away view, in perspective, of components shown in FIG. 17 and additional components of the platen alignment mechanism.

FIGS. 17 and 18 illustrate the components of a platen alignment mechanism for accurately positioning the platen arms 18 at the printing stations 26.

As shown in FIGS. 17 and 18, one end of the platen support arm 18 carries, at its underside, a vertical plate 160, on which first locating members in the form of a pair of rollers 162 are mounted so as to be freely rotatable about respective horizontally spaced horizontal axes. This end of the platen support arm 18 is mounted on a transverse plate 161, to the underside of which is secured a block 163 of low friction plastic material, which slidably supports the platen support arm 18 for movement along the rail 20.

The plate 161 has been shown broken-away in FIG. 18 to facilitate illustration of components beneath the plate 161.

Two further pairs of rollers 164 are freely rotatably mounted on a roller support plate 166 which is, in turn, secured to the machine frame 24. The rollers 164 have V-shaped peripheries which engage in correspondingly V-shaped recesses 168 at opposite vertical sides of a locating member in the form of a second vertical bar 170.

The bar 170 is vertically movable, to and fro, and the rollers 164 are guide rollers which are in guiding engagement with the bar 170 and guide this vertical movement of the bar 170 and which retain the bar 170 against horizontal displacement.

Guided by the rollers 164, the bar 170 can be raised into a first position, in which it is located between and in engagement with the rollers 162, and lowered into a second position, in which it is shown in FIG. 17, and in which it is spaced from the rollers 162 and the other components of the platen support arm 18.

The rollers 162 have V-shaped peripheries for rolling engagement with the recesses 168 in the opposite sides of the bar 170, so that on displacement of the bar 170 upwardly into its first position, the bar 170 accurately determines the horizontal location of the respective end of the platen support arm 18. More particularly, due to the interengagement of the V-shaped roller peripheries and bar recesses, the bar 170 accurately positions the platen support arm 18 both longitudinally of the arm 18, i.e. in a first direction extending transversely of the path of travel of the platens 12, and also transversely of the arm, i.e. longitudinally of that path in a second direction at the right angles to the first direction. The rollers 162 are adjustable relative to their plate 160, and the plate 160 is adjustably mounted on a support plate 167 forming part of the machine frame 24.

The opposite end of the platen support bar 18, as illustrated in FIG. 18, is located in position by a locating mechanism, indicated generally by reference numeral 172, which comprises a locating member in the form of an arm 174 having, along its length, a downwardly convergent V-shaped underside which is engageable in an upwardly open, correspondingly V-shaped recess 176 in the platen support arm 18.

The arm 174 is mounted at the upper end of a bar 178 which is vertically displaceable, to and fro, by means of a pneumatic piston and cylinder device 180, the movement of the bar 178 being guided by means of two pairs of guide rollers 182, which engage opposite vertical sides of the bar 178 and only two of which are shown in FIG. 17. Thus, the underside of the arm 174 is a V-shaped downwardly directed protrusion formation which is snugly engageable in the correspondingly V-shaped upwardly open recess formation of the recess 176.

For effecting the relative movement of the vertical bar 170 and the rollers 162, there is provided an actuator mechanism comprising a pneumatic piston and cylinder device 184 and a crank arm 185 on a shaft 186 journaled in the machine frame 24, with a further crank arm 187 on the shaft 186 and a link 188 connecting the shaft 186 to the vertical bar 170.

Figure 19:
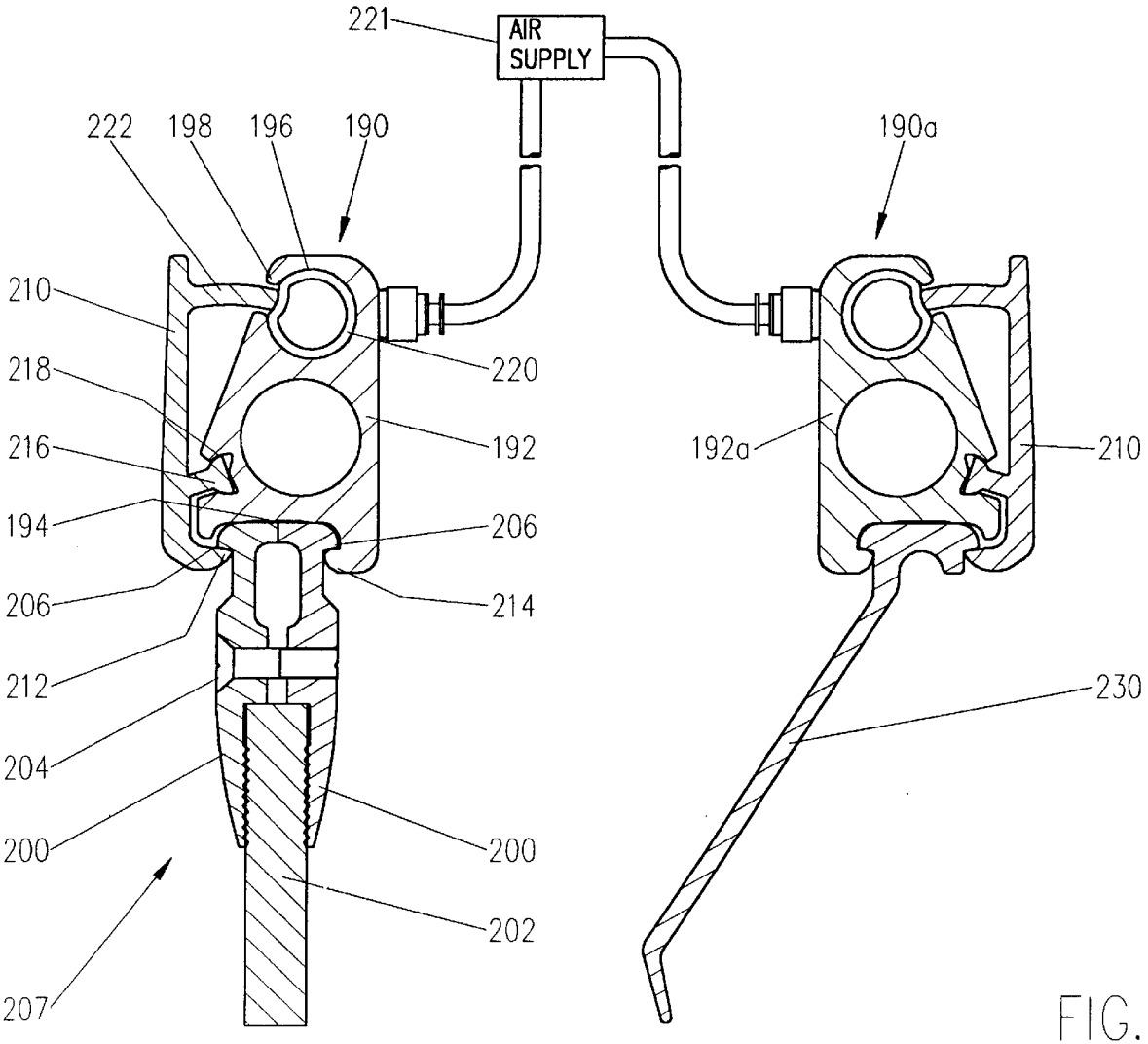
FIG. 19 shows a view taken in transverse cross-section through a squeegee holder and an associated squeegee forming parts of the printing machine of FIG. 1.

FIG. 19 shows a squeegee holder indicated generally by reference numeral 190. This squeegee holder 190 comprises a squeegee support bar in the form of an extrusion 192, which is formed with a recess 194 at its underside, and with a cylindrical passage 196 adjacent its top, the passage 196 being open to the exterior of the extrusion 192 through a gap 198.

A pair of clamping strips 200, which are urged towards one another into clamping engagement with a squeegee blade 202 by means of screws, one of which is indicated by reference numeral 204, are each formed with an upper edge having a lateral projection 206. Elongate retainer 210, formed as an extrusion, extends longitudinally of the squeegee holder 190 and has, along its underside, a laterally projecting edge portion 212. As can be seen in FIG. 19, the lateral projections 206 of the two clamping strips 200 are engaged, respectively, by this projecting edge portion 212 and by a longitudinal projection 214 on the extrusion 192. In this way, the clamping strips 200, which together with the squeegee blade 202 form a squeegee 207, are retained in the recess 194 and, thus, are secured relative to the squeegee holder 190.

The elongate retainer 210 is formed with a further lateral projection 216, which is engaged in a recess 218 extending longitudinally of the extrusion 192 at one side of the extrusion 192. The projection 216 and the recess 218 are shaped and dimensioned so as to allow the projection 216 to rock or pivot to and fro, about an axis (not shown) extending longitudinally of the squeegee holder 190 in order, thus, to allow the projecting edge portion 212 of the elongate retainer 210 to be moved to and fro, relative to the extrusion 192, into an operative position, in which it is shown in FIG. 19 and in which the projecting edge portion 212 is located near the recess 194 for releasibly engaging and retaining the squeegee 207 relative to the extrusion 192, and a released position, in which the projecting edge portion 212 is disengaged from the projection 206 of the left-hand clamping strip 200, as viewed in FIG. 19, so as to thus release the squeegee 207 from the squeegee holder 190.

The squeegee holder 190 also includes an actuator device comprising an elongate inflatable tube 220 which extends longitudinally of the extrusion 192 and which can be inflated by compressed air from a compressed air supply 221. The elongate retainer 210 includes a further longitudinal, laterally projecting portion 222, which extends laterally of the elongate retainer 210 into engagement with the inflatable tube 220. More particularly, the tube 220 is received within, and extends longitudinally of, the passage 196, and the projecting portion 222 extends through the gap 198, which extends longitudinally of the extrusion 192, into engagement with the tube 220. It will be apparent that, on inflation of the tube 220, the elongate retainer 210 is rocked or pivoted in an anti-clockwise direction, as viewed in FIG. 19, so as to urge the projecting edge portion 212 into its operative position, i.e. into retaining engagement with the respective projecting edge portion 206 of the squeegee.

FIG. 19 also shows a view in cross-section through a flood bar holder 190*a* comprising an extrusion 192*a* which is identical to the extrusion 190 of the squeegee holder 190, the extrusion 192*a* being equipped with an elongate retainer 210*a* identical to the elongate retainer 210 but facing in an opposite lateral direction from that of the extrusion 192. The elongate retainer 210*a* releasibly retains a flood bar 230 relative to the squeegee holder 190*a* in a manner which, as is readily apparent, is closely analogous to the above-described retention of the squeegee relative to the squeegee holder 190.

The squeegee holder 190 and the flood bar holder 190*a* are moved to and fro across the respective printing screen by a suitable mechanism, as disclosed in U.S. Pat. No. 5,626,074, issued May 6, 1997, to the present invention, the disclosure of which is incorporated herein by reference.

As will be apparent to those skilled in the art, various additions and other modifications may be made to the above-described apparatus within the scope and spirit of the appended claims.

I claim:

1. A screen printing machine, comprising:

a plurality of printing stations;

a plurality of platens;

a drive mechanism operable to displace said platens along an endless horizontal path through said printing stations in succession;

a printing screen at each of said printing stations;

a screen loading/unloading mechanism at each of said printing stations;

said screen loading/unloading mechanisms each comprising screen holders engageable with opposite sides of said screen;

said screen holders each comprising a screen support mounted for pivotation to and fro between a first position beneath said screen and a second position removed from said screen; and a lifting mechanism for displacing said screen holders to and fro from said first position.

2. A screen printing machine as claimed in claim 1, wherein said screen holders each comprise screen clamps, said screen clamps each comprising a clamping member movable into a clamping position, in which said screen clamp engages said screen between said screen clamp and said screen support, and an actuator operable to displace said screen clamp to and from said clamping position.

3. A screen printing machine as claimed in claim 1, wherein said screen holders each include an adjustment mechanism operable to adjust the position of said screen holder and to thereby correspondingly adjust the position of a respective one of said screens.

4. A screen printing mechanism as claimed in claim 1, wherein said screen holders and said screens have locating formations which are mutually engageable to position said screens.

5. A screen printing machine as claimed in claim 4, wherein said screen holders each include an adjustment mechanism operable to adjust the position of said locating formation thereof and, thereby, to correspondingly adjust the position of a respective one of said screens on interengagement of said locating formations.

6. A screen printing machine as claimed in claim 5, wherein said adjustment mechanism comprises independently actuatable mechanisms for adjustably displacing said locating formation of the respective one of said screen holders in mutually orthogonal horizontal directions.

7. A screen printing machine as claimed in claim 5, wherein said screen holders each comprise screen clamps, said screen clamps each comprising a clamping member movable with a clamping position, in which said screen clamp engages said screen between said screen clamp and said screen support, and an actuator operable to displace said screen clamp to and from said clamping position.

8. A screen printing machine, comprising:

a plurality of printing stations;

a plurality of printing platens;

a platen drive mechanism operable to displace said printing platens along an endless horizontal path through said printing stations in succession;

a printing screen located above said endless path at each of said printing stations;

an elongate printing head extending over said endless path at each of said printing stations and carrying one of said printing screens;

said printing heads having opposite ends;

a printing head lifting system at each of said printing stations;

said printing head lifting systems each comprising printing head supports positioned to support said opposite ends of a respective one of said printing heads and a support drive mechanism operable to simultaneously raise said printing head supports.

9. A screen printing machine as claimed in claim 8, wherein said support drive mechanism comprises a prime mover and a belt and pulley system connected to be driven by said prime mover, said belt and pulley system comprising a first pair of horizontally spaced, vertically extending belts at an outer side of said endless path, a second pair of horizontally spaced, vertically extending belts at an inner side of said endless path and connections between each of said belts and said printing head supports.

10. A screen printing machine as claimed in claim 8, further comprising a pivot supporting said printing head at one of said opposite ends thereof; an actuator operable to pivot said printing head about said pivot and thereby to raise and lower the other of said opposite ends thereof from an operative position, and a locking device for releasibly retaining said other end in said operative position.

11. A screen printing machine as claimed in claim 10, wherein said locking device comprises a pair of oppositely operating piston and cylinder devices; a pair of locking members mounted for displacement by respective ones of said piston and cylinder devices and locking recess engageable by said locking pins.

12. A screen printing machine as claimed in claim 11, further comprising an abutment and a counter-abutment, one of said piston and cylinder devices having a cross-sectional area greater than the other so as to urge said abutment against said counter-abutment on extension of said piston and cylinder devices.

13. A screen printing machine, comprising:

a machine frame;

a plurality of printing stations on said machine frame;

a plurality of printing platens;

platen supports for carrying said platens;

a platen drive mechanism operable to displace said printing platens along an endless path through said printing stations in succession; and a platen alignment mechanism at each of said printing stations;

said platen alignment mechanisms comprising first locating members on said platen supports, second locating members mounted on said machine frame, said first and second locating members being relatively movable vertically to and fro between first positions, in which said first locating members are engaged with said second locating members to thereby locate said platen supports, and second positions, in which said locating members are disengaged from said first locating members, and actuator mechanisms operable to effect the relative movement of said first and second locating members between said first and second positions.

14. A screen printing machine as claims in claim 13, wherein said first and second locating members are provided at an outer side of said endless path at said printing stations and wherein a locating mechanism is provided at an inner side of said endless path at each of said printing stations, said locating mechanisms comprising further locating members; said platen supports and said further locating members having mutually interengageable V-shaped protrusion and recess formations and said further locating members being mounted for vertical to and fro movement between engaged positions, in which said V-shaped protrusion and recess formations are interengaged, and disengaged positions, in which said V-shaped protrusion and recess formations are disengaged.

15. A screen printing machine as claimed in claim 14, wherein said V-shaped recess formations comprise upwardly open recesses in said platen supports and said V-shaped protrusion formations comprise downwardly tapering protrusions located above said endless path.

16. A screen printing machine as claimed in claim 14, wherein said locating mechanism includes two pairs of guide rollers interengaged with opposite vertical sides of said further locating member.

17. A screen printing machine as claimed in claim 13, wherein said endless path is horizontal and said first and second locating members are shaped so as to locate said platen supports in a first horizontal direction transverse to said path and in a second horizontal direction at right angles to said first horizontal direction on engagement of said first locating members with said second locating members.

18. A screen printing machine as claimed in claim 13, wherein said second locating members are movable to and fro vertically between said first and second positions by said actuator mechanisms.

19. A screen printing machine as claimed in claim 18, wherein said first locating members comprise rollers, said second locating members comprise elongate members, and said rollers and said elongate members have V-shaped formations which are mutually interengageable on displacement of said locating members vertically with said first positions.

20. A screen printing machine as claimed in claim 18, wherein said first locating members comprise pairs of alignment rollers carried by said platen supports, said rollers being rotatable about horizontal axes extending transversely of said endless path and having V-shaped peripheries, and said second locating members comprising elongate members having V-shaped recesses for interengagement with said V-shaped peripheries on relative movement of said first and second locating members into said first positions, said pairs of rollers each being horizontally spaced to receive one of said elongate members therebetween.

21. A screen printing machine as claimed in claim 19, further comprising guide rollers in guiding engagement with said elongate members.

22. A printing machine squeegee holder, comprising:

a squeegee support bar;

a recess extending longitudinally of said squeegee support bar at an underside thereof;

an elongate retainer extending longitudinally of said squeegee support bar;

said elongate retainer having a projecting portion;

said elongate retainer being movable relative to said squeegee support bar between an operative position, in which said projecting portion is located near said recess for releasibly engaging and retaining a squeegee relative to said squeegee support bar, and a released position, in which said projecting portion is withdrawn from said recess to release said squeegee from said squeegee support bar; and an actuator device on said squeegee support bar, said actuator device being operable to displace said elongate retainer relative to said squeegee support bar from said released position to said operative position.

23. A printing machine squeegee holder as claimed in claim 20, wherein said elongate retainer is pivotable relative to said bar between said operative and released positions about an axis of pivotation extending longitudinally of said bar and said elongate retainer.

24. A printing machine squeegee holder as claimed in claim 22, further comprising an elongate inflatable tube extending longitudinally of said bar, said elongate retainer including a longitudinal laterally projecting portion in contact with said tube, and a source of pressurized fluid connected to said tube for inflating said tube to thereby displace said elongate retainer from said released position to said operative position.

25. A screen printing machine, comprising:

a machine frame;

a plurality of printing stations on said machine frame;

a plurality of printing platens;

platen supports for carrying said platens;

a platen drive mechanism operable to displace said printing platens along an endless horizontal path through said printing stations in succession;

a printing screen located above said endless path at each of said printing stations;

an elongate printing head extending across said path at each of said printing stations and carrying one of said printing screens, said printing heads having opposite ends;

a printing head lifting system at each of said printing stations;

said printing head lifting systems each comprising printing head supports positioned to support said opposite ends of a respective one of said printing heads and a support drive mechanism operable to simultaneously raise said printing head supports;

a platen alignment mechanism at each of said printing stations;

said platen alignment mechanisms comprising first locating members on said platen supports, second locating members mounted on said machine frame, said first and second members being relatively movable vertically to and fro between first positions, in which said first locating members are engaged with said second locating members to thereby locate said platen supports, and second positions, in which said locating members are disengaged from said first locating members, and actuator mechanisms for effecting the relative movement of said first and second locating members between said first and second positions;

a screen loading/unloading mechanism at each of said printing stations;

said screen loading/unloading mechanisms each comprising screen holders engageable with opposite sides of one of said screens;

said screen holders each comprising a screen support mounted for pivotation to and fro between a first screen holder position beneath said screen and a second screen holder position removed from said screen;

a lifting mechanism for displacing said screen holders to and from said first position;

a squeegee support bar;

said squeegee support bar including a recess extending longitudinally of said squeegee support bar at an underside thereof, and an elongate retainer extending longitudinally of said squeegee support bar, said elongate retainer having a projecting portion, and said elongate retainer being movable relative to said squeegee support bar between an operative position, in which said projecting portion is located near said recess for releasibly engaging and retaining a squeegee relative to said squeegee support bar, and a released position, in which said projecting portion is withdrawn from said recess to release said squeegee from said squeegee support bar; and an actuator device on said squeegee support bar, said actuator device being operable to displace said elongate retainer relative to said squeegee support bar from said released position to said operative position.

* * * * *